United States Patent [19]

Mathiesen et al.

[11] Patent Number: 4,887,383

[45] Date of Patent: Dec. 19, 1989

[54] PROCESS FOR PRODUCING A SLURRY OF A PULVERIZED CARBONACEOUS MATERIAL

[75] Inventors: Mait M. Mathiesen, Arild; Lars I. Gillberg, Lund; Karl M. E. Hellsten, Ödsmål; Gunvor B. T. Karlsson, Stenungsund, all of Sweden

[73] Assignees: AB Carbogel, Helsinigborg; Berol Kemi AB, Stenungsund, both of Sweden

[21] Appl. No.: 125,184

[22] Filed: Nov. 25, 1987

Related U.S. Application Data

[63] Continuation of Ser. No. 905,753, Sep. 9, 1986, abandoned, which is a continuation of Ser. No. 492,194, May 6, 1983, abandoned.

[30] Foreign Application Priority Data

May 7, 1982 [SE] Sweden ..... 8202879

[51] Int. Cl.[4] ..... C10L 1/32

[52] U.S. Cl. ..... 44/51; 241/13; 241/15; 241/29

[58] Field of Search ..... 44/51; 241/13, 15, 29; 406/47, 49, 197

[56] References Cited

U.S. PATENT DOCUMENTS

| | | | |
|---|---|---|---|
| 2,346,151 | 4/1944 | Burk | 44/51 X |
| 2,359,325 | 10/1944 | McConnell | 44/51 X |
| 2,842,319 | 7/1958 | Reerink et al. | 241/29 |
| 3,012,826 | 12/1961 | Puff et al. | 416/47 |
| 3,168,350 | 2/1965 | Phinney et al. | 44/51 |
| 3,420,453 | 1/1969 | Tada et al. | 241/15 |
| 3,524,682 | 8/1970 | Booth | 302/66 |
| 3,712,549 | 1/1973 | Cleemann | 241/29 |
| 3,762,887 | 10/1973 | Clancey | 44/51 X |
| 3,912,174 | 10/1975 | Karpinski et al. | 241/29 |
| 3,928,182 | 12/1975 | Eder | 241/24 |
| 4,076,505 | 2/1978 | Dessau | 44/1 R |
| 4,094,810 | 6/1978 | Thomas | 44/51 X |
| 4,132,365 | 1/1979 | Verschuur | 241/29 |
| 4,162,044 | 7/1979 | Manfroy (Dow) | 241/16 |
| 4,162,045 | 7/1979 | Katzer (Dow) | 241/16 |
| 4,242,098 | 12/1980 | Braun et al. | 44/51 |
| 4,282,006 | 8/1981 | Funk | 44/51 |
| 4,302,212 | 11/1981 | Yamamura et al. | 44/51 |
| 4,358,293 | 11/1982 | Mark | 44/51 |
| 4,369,926 | 1/1983 | Rusmussen et al. | 241/29 |

FOREIGN PATENT DOCUMENTS

| | | | |
|---|---|---|---|
| WO81/01296 | 5/1981 | European Pat. Off. | 44/51 |
| 0077909 | 4/1983 | European Pat. Off. . | |
| 1644942 | 4/1977 | Fed. Rep. of Germany . | |
| WO83/00500 | 2/1983 | PCT Int'l Appl. . | |
| 0675511 | 7/1952 | United Kingdom | 44/51 |

*Primary Examiner*—Mark L. Bell
*Assistant Examiner*—Margaret B. Medley
*Attorney, Agent, or Firm*—Gordon W. Hueschen

[57] ABSTRACT

A process for producing a slurry of a pulverized carbonaceous material having a predetermined particle size distribution with a certain average particle size and a certain maximum particle size is described. The process, which includes a comminuting phase comprising at least two milling stages and combining the milled material with a carrier liquid to provide the slurry is characterized by the following steps:

(a) that the carbonaceous material is milled in a first milling stage;

(b) that the milled product from stage (a) is divided into coarse material having a particle size which at least is larger than the average particle size of the predetermined particle size distribution and into fine material having a particle size smaller than that of the coarse material;

(c) that the coarse material from stage (b) is milled in at least one further milling stage to produce at least one further portion of fine material, the average particle size of which is smaller than the average particle size of the final slurry; and (d) that a slurry is produced of the combined portions of fine material from the different stages.

11 Claims, 1 Drawing Sheet

FIG. 1
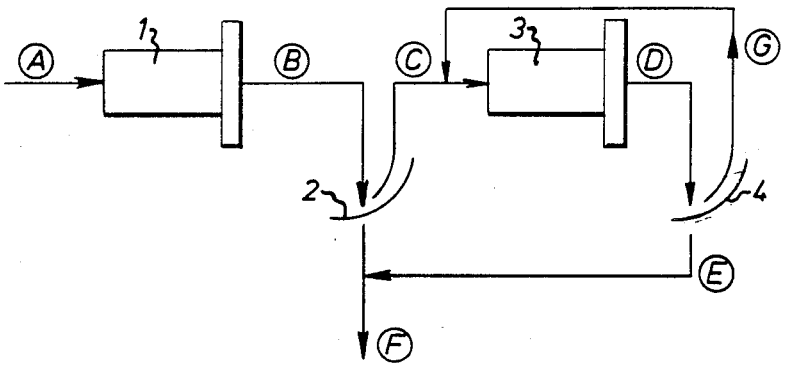
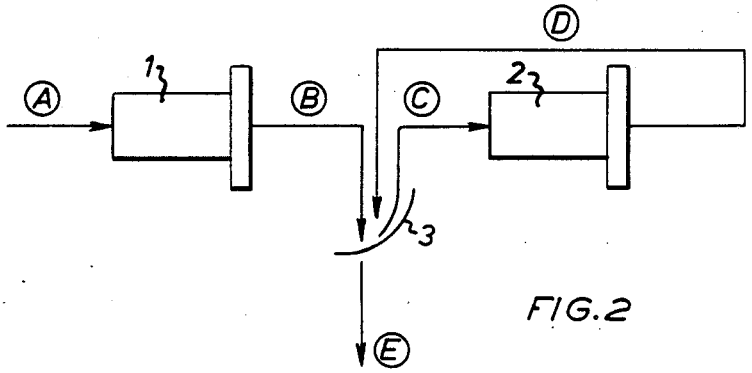
FIG. 2

PROCESS FOR PRODUCING A SLURRY OF A PULVERIZED CARBONACEOUS MATERIAL

This is a continuation of application Ser. No. 905,753, filed Sept. 9, 1986, which in turn is a continuation of Ser. No. 492,194, filed May 6, 1983, both now abandoned.

The present invention relates to a process for producing slurries of solid fuel in the form of pulverized carbonaceous material.

The term "solid fuel" as used in the context of this invention comprises different types of carbonaceous materials, such as bituminous, anthracitic, sub-bituminous and lignitic coal, charcoal and solid refinery by products such as petroleum coke, asphaltene, etc.

Present day heat production is largely based on the combustion of liquid or gaseous fuels, and existing plants therefore are adapted to the transport, storage and combustion of fuel in these physical forms. Transition to lump coal would involve extensive reconstruction and new investments and it is therefore a matter of course that a keen interest has been shown in different processes for converting coal into liquid or gaseous fuel products. In addition to chemical conversion of coal into methanol or hydrocarbons, it has also been proposed to produce a slurry of coal powder in different liquids, such as methanol, oil, mixtures of water and oil, or water alone. Thus a solid fuel such as coal may be handled and transported as a liquid, whilst reducing or eliminating the amount of liquid fuel, such as oil, to be used in the applications of the slurry fuels.

In a number of cases, a slurry of coal and water offers the greatest practical and economical advantages. Many demands are made on solid fuel slurries, the most important of which is that the slurry have a high solid fuel content whilst displaying favorable handling properties, i.e. low apparent viscosity and homogeneity even during long storage periods. Several processes for the production of slurry fuels have been proposed.

U.S. Pat. Ser. No. 4,282,006 discloses a coal water slurry preparation process wherein crushed coal is milled in a ball mill whereupon minor portions of milled coal are further milled in separate ball mills to satisfy the demand for sufficient amounts of fine particles in the pulverized coal compact to be used in the slurry. The process is less than fully continuous and is characterized in that the first mill produces particles smaller than or of equal size with the largest particles in the slurry. Hence the size distribution produced is highly dependent on the mode of coal fracture in the primary mill which leads to considerable inflexibility in producing desirable size distribution.

Occidental Research Corporation, of Irvine, CA have published a paper ("Formulation, Handling and Combustion Characteristics of Coal-Water Mixtures", Coal Technology '82, 5the International Coal Utilization Exhibition and Conference, Dec. 7-9, 1982, Houston, TX) wherein a slurry production process is disclosed. It includes a primary dry comminution step which produces particles within the final slurry particle size range and a secondary fine grinding step wherein a fraction of the primary mill product is further milled to provide sufficient amounts of fine particles. The comminution method suffers from the same type of disadvantage as the one disclosed in U.S. Pat. Ser. No. 4,282,006.

A further coal water slurry production process is described by Atlantic Research Corporation, Alexandria, VA (Electric Power Research Institute Report CS-2287, Mar., 1982) wherein the coal feed is divided into two streams prior to milling. One stream is taken through two mills, a dry hammer mill followed by a wet ball mill, with no intermediate classification, and the other stream is milled in a dry cage mill in a closed operation. The milled solids from both streams are combined in the slurry. This arrangement also produces in two parallel streams particles in the final slurry particle size range and does not permit sufficient flexibility in achieving the desired particle size distribution in the slurry.

Regarding the particle size distribution in the slurry, aqueous or non-aqueous, it is a well-known fact that the size distribution of a particle aggregation can be optimized in order to minimize the viscosity of a suspension of the particle aggregation at any given solids concentration. The theory for this has been well described by Farris (Trans. Soc. Rheology 12:2,pages 281-301, 1968).

As an example, Farris' work gives the ideal size distribution for a 75 wt % coal/water slurry with a particle top size of 200 microns, assuming a filler density of 1.2, as follows:

TABLE 1

| Wt % coal | particle size (μm) |
|---|---|
| 100 | −200 |
| 92 | −160 |
| 79 | −100 |
| 70 | −70 |
| 59 | −44 |
| 42 | −20 |
| 29 | −10 |

In making a slurry it is generally the objective to achieve an ultimate size distribution which allows a high degree of packing of solid particles in a given unit volume of slurry. Even if the actual intent is not one of achieving a very high solids content slurry it is still desirable to use solid particles of a size distribution which allows high solids content since such a slurry at any slurry liquid content displays more favorable rheological properties than slurries incorporating particles of a poorer size distribution.

The published work by Farris shows that there is a size distribution, at any given maximum particle size in the slurry solids, that allows a higher degree of solids content than any other distribution. In general, the ideal distribution contains larger amounts of fine and coarse material within the distribution than is typically produced in a single milling step. An open milling circuit, i.e. one with no internal or external classifying operation produces on an average finer material than a closed milling operation when producing a product of identical particle top size but they both produce distributions which tend to concentrate too much product in the intermediate size range, i.e. too narrow distributions.

According to the present invention, however, there is provided a process to achieve the desired size distribution at any given particle top size in a continuous manner by carrying out the following steps:

1. The carbonaceous starting material, having previously been reduced to such size that it can readily be milled, is introduced into a primary mill where it is purposely milled to a size distribution which is coarser than the desired slurry size distribution;

2. the milled product from the primary mill is subsequently introduced to a classifying device where a coarse fraction is removed. The cut-point is preferably so chosen that the coarsest particles of the finer fraction are of a size equal to or coarser than the average particle size of the final slurry, but smaller than or equal to the maximum particle size of the final slurry, preferably about equal to the maximum particle size of the final slurry;

3. the coarse fraction is subsequently introduced to a succeeding mill or a plurality of succeeding mills, where the milling energy per unit charged material can be varied from that in the primary mill, thus providing the operator to mill this fraction to whatever size is required for the combination of products from each succeeding mill, or the fines separated therefrom, and fines separated from the primary mill to proximate the ideal or desired size distribution.

These steps can be carried out in a number of milling stages, each milling stage consisting of at least one mill and optionally a classifier, except the first milling stage wherein the use of a classifier is required. Preferably, the total number of milling stages is two. As options for the last milling stage, either the classifier of any preceding milling stage may be used, or no classifier at all. The classifiers in each milling stage subsequent to the first are preferably so chosen that the separated fines fraction, to be combined with the fines from the first milling stage to form the slurry solids content, is of a size distribution such that the maximum particle size is equal to or smaller than the maximum particle size in the slurry. Preferably the maximum particle size of the fines from the succeeding milling stages to be combined in the slurry with the fines separated in the first milling stage are of a maximum particle size and an average particle size equal to or smaller than the maximum and average particle sizes, respectively, of the fines separated in the first milling stage.

Thus, it is achieved that the requirement for sufficient coarse material in the final slurry is essentially provided in the first milling stage, whereas the coarse material separated in the first milling stage will essentially contribute to the finer particle fractions through the subsequent milling operations. This affords the operator to achieve the desired size distribution in each case on a continuous basis irrespective of the tendencies in each separate milling operation to produce unfavourable size distributions.

A further advantage may be gained by selecting the capacities of the succeeding mill or mills higher than would be required under normal operating conditions. This then allows for compensation of any operational disturbances causing the primary milling operation to produce coarser product than intended by increasing the grinding work carried out in the succeeding milling operations whereby the size distribution of the combined fines can be kept near constant, assuring near constant slurry properties at all times.

An object of the present invention is thus to provide a process for producing a slurry of a pulverized carbonaceous material having a predetermined particle size distribution with a certain average particle size and a certain maximum particle size, said process including a comminuting phase comprising at least two milling stages and combining the milled material with a carrier liquid to provide the slurry, characterized in (a) that the carbonaceous material is milled in a first milling stage;

(b) that the milled product from stage (a) is divided into coarse material having an average particle size which at least is larger than the average particle size of the predetermined particle size distribution and into fine material having an average particle size smaller than that of the coarse material;

(c) that the coarse material from stage (b) is milled in at least one further milling stage to produce at least one further portion of fine material, the average particle size of which is smaller than the average particle size of the final slurry; and (d) that a slurry is produced of the combined portions of fine material from the different stages.

This as well as other objects and advantages with the present invention will be further apparent from the following specification together with the accompanying drawings of the process according to the invention which are further described in Examples 1 and 2, respectively.

The flexibility afforded the operator in terms of achieving desirable size distributions by regulating the amount of grinding carried out in each milling stage and by selecting the cut-points in the classifying operations is of importance not only in terms of achieving favorable packing conditions in the final slurry. In many instances a number of factors must be weighed against each other in order to determine the best distribution. The main factors to be considered are:

Maximum particle size in the slurry. This is normally dictated by the intended slurry end use, i.e. a maximum particle size to ensure sufficient burn-out in a particular combustion facility.

Liberation characteristics of the particular carbonaceous material used. In many instances it is desirable to remove inorganic constituents from the carbonaceous starting material prior to making the slurry. The finer the material is ground the more inorganic matter is liberated and thus the operator may either choose to lower the top size or reduce the amount of coarse material in order to gain in impurities removal in a separation process prior to making the slurry.

Cost of milling. The finer the average particle size of the slurry, the costlier is the milling process.

Effective surface area of the milled product. Frequently the final slurry composition includes chemical additives to enhance slurry flow properties and stability. Such additives frequently contain surface active components and thus a large effective surface area contributes to an increase in additive concentration.

Taking into consideration the above factors and the desirability of obtaining a size distribution which provides sufficient particle packing in the slurry, the operator may select a target size distribution and use the mill and classifier arrangement described above to produce it. Normally the maximum particle size ranges from 50 to 500 microns, preferably 50 to 250 microns, 50–95% of the material from the first mill will be of this top size or smaller and the 5 to 50% of particles exceeding the selected top size will be separated in the classifying step in the first milling stage and further milled in the subsequent milling stage or stages to an average size equal to or preferably less than the average size of the fines separated in the first milling stage. Preferably, the first milling stage produces 60 to 85% particles of sufficient fineness to be included in the slurry.

For some applications, however, such as the burning of the fuel slurry in a fluidized bed or the injection of the fuel slurry into blast furnaces, the particle size of the pulverized, carbonaceous material is not especially critical, and the fuel slurry may include relatively large particles, without causing any difficulties. However, one should not go beyond a particle size of about 0.5 mm because of the risk of particle sedimentation which may occur if the particles are too large.

EXAMPLE 1

In this example the mill arrangement according to FIG. 1 of the enclosed drawing is used. The mill arrangement includes two milling stages with one wet ball mill in each stage, More particularly, the first milling stage consists of a primary mill 1, and a sieve bend 2, and the second milling stage consists of a secondary mill 3 and a sieve bend 4. The sieve bend openings are so chosen that sieve bend 2 separates material coarser than the acceptable slurry maximum particle size and sieve bend 4 separates equally coarse or finer particles which are fed back to the mill 3. The material flow is the following:

(A) The carbonaceous starting material and sufficient water is introduced to the primary mill;

(B) milled product with 5 to 50% material coarser than the final slurry solids exits the mill;

(C) the 5 to 50% coarser material is separated on the sieve bend 2 and milled in the secondary mill 3;

(D) milled product from the secondary mill 3 is taken to a second sieve bend 4, where fine fraction (E) is separated and combined with the fines from sieve bend 2 to form final milled product, (F);

(G) coarse product from sieve bend 4 is recycled to the secondary mill 3;

(F) is combined with slurry liquid to form the slurry product.

Example 2

An aqueous slurry based on a high volatile bituminous coal (ex Cape Breton Development Corporation, Nova Scotia, Harbour seam coal) was to be produced. The selected maximum slurry particle size was 200 microns and the slurry loading was selected to be 75% by weight. The ideal Farris distribution called for the following distribution:

TABLE 2

| weight percent particles | particle size (μm) |
|---|---|
| 100 | −200 |
| 85.5 | −125 |
| 76.5 | −88 |
| 67.0 | −63 |
| 59.5 | −45 |
| 51.0 | −31.5 |
| 42.0 | −20 |
| 32.5 | −12.5 |

Milling the coal in a wet ball mill with a hydrocyclone separating coarse particles which were fed back to the same mill yielded the following distribution:

TABLE 3

| weight percent particles | particle size (μm) |
|---|---|
| 100 | −200 |
| 99 | −125 |
| 94 | −88 |
| 86 | −63 |
| 75 | −45 |
| 61 | −31.5 |
| 43.5 | −20 |
| 29 | −12.5 |

The distribution thus achieved was unsatisfactory. It was also concluded that an ideal Farris distribution would result in excessive additive consumption in the manufacture of the fuel wherefore it was decided to produce a particle size distribution with somewhat less fines size particles than indicated as desirable in Table 2, but yet with sufficient amounts of the larger particle sizes to obtain a slurry with sufficient flow properties at 75% loading. In order to achieve this a milling arrangement according to FIG. 2 was used. The milling arrangement according to FIG. 2 includes two milling stages with one wet ball mill in each stage and no separate classifier in the last milling stage.

In the arrangement according to FIG. 2, the sieve bend 3 opening was chosen such that particles exceeding the slurry particle top size, 200 microns, were separated and further milled in the second milling stage. The capacity of the sieve bend 3 was sufficient to yield efficient separation of coarse material from the milled product of both milling stages.

The material flows were the following:

The carbonaceous starting material with sufficient water, about 50% by weight and of a particle size of minus 1.5 inch diameter (A) was fed into the ball mill 1 of the first milling stage. The product (B) from the first mill 1 contained 30 to 35% material exceeding 200 μm size throughout the campaign which was separated on the sieve bend 3 and fed into the ball mill 2 in the second milling stage where it was reduced further in size whereupon it (D) was taken to the sieve bend in stage one to contribute to the combined fines stream (E), which had the following size distribution:

TABLE 4

| weight percent particles | particle size (μm) |
|---|---|
| 100 | −200 |
| 90.5 | −125 |
| 81.0 | −88 |
| 70.0 | −63 |
| 59.5 | −45 |
| 49.0 | −31.5 |
| 33.0 | −20 |
| 21.5 | −12.5 |

The slurry prepared from the milled product (E) had a solids concentration of 75% by weight and exhibited satisfactory rheological properties.

Having effected the comminution process according to the above, the fines fractions from the plurality of milling stages are combined and mixed with the selected carrier liquid to form a pulverized carbonaceous material slurry, with or without flow-modifying chemical additives.

In some instances, however, it is favorable to carry out a benefication step in order to remove from the milled carbonaceous material inorganic impurities associated with the starting material and liberated from it in the comminution step. It is particularly suitable to carry out the comminution step in wet mills followed by wet benefication processing if the slurry to be produced is aqueous. In such a case the slurry produced in the comminution process is suitably diluted from the 50 to 25 weight percent solids concentration normally employed in the comminution step to typically 5 to 20, preferably 7 to 15, weight percent solids in an arrangement of flotation cells wherein organic particles are separated from inorganic particles. It is essential hereby that sufficient retention time is provided, normally 5 to 45 minutes depending on solids concentration and size.

Normally the flotation process is carried out in a rougher series followed by a cleaner series of flotation cells, whereby reagents such as frothers, promoters and depressants can be added independently to each cell in each series.

The thus benificiated carbonaceous pulverized material is then dewatered to 35 to 15 weight percent by means of sedimentation and/or filtration techniques, whereupon the dewatered slurry is used as such or mixed with flow-modifying chemical additives prior to pumping into storage.

If a non-aqueous slurry is to be produced, the dewatering process is suitably used to produce even lower moisture contents prior to combining the beneficiated pulverized carbonaceous material with the slurry liquid in the mixing process.

In conclusion, from the foregoing, it is apparent that the present invention provides a novel process for producing a slurry of a pulverized carbonaceous material involving a comminution phase, an optional beneficiation phase carried out in dilute aqueous phase and a slurry mixing phase, as well as a novel method of carrying out said comminution to produce a carbonaceous material slurry, all having the foregoing enumerated characteristics and advantages.

It is to be understood that the invention is not to be limited to the exact details of operation, or to the exact compositions, methods, procedures, or embodiments shown and described, as obvious modifications and equivalents will be apparent to one skilled in the art, and the invention is therefore to be limited only by the full scope of the appended claims.

What we claim and intend to secure by Letters Patent is:

1. A process for producing a slurry of a pulverized carbonaceous material having a particle size distribution with a certain average particle size and a certain maximum particle size, said process including a comminuting phase comprising at least two different milling stages, each including at least one mill, and combining the milled material with a carrier liquid to provide the slurry, characterized in (a) that the carbonaceous material is milled in a first milling stage;

(b) that the milled product from stage (a) is divided into coarse material having an average particle size which is larger than the average particle size of the ultimate particle size distribution and into fine material having a particle size smaller than that of the coarse material;

(c) that the coarse material from stage (b) is milled in a different further milling stage to produce a further portion of fine material, the average particle size of which is smaller than the average particle size of the final slurry; and (d) that a slurry is produced of the combined portions of fine material from the different stages.

2. In a process for producing a slurry of a pulverized carbonaceous material having an ultimate particle size distribution with a certain average particle size and a certain maximum particle size from carbonaceous material having an average particle which is greater than a desired particle size distribution, said process including a comminuting phase comprising at least two different milling stages, each including at least one mill, and combining the milled material with a carrier liquid to provide the slurry, and wherein an optimum particle size distribution is present, comprising the steps of:

(a) milling the carbonaceous material in a first milling stage to produce both coarse and fine material; and (b) dividing the milled product from stage (a) into coarse and fine material fractions, the improvement which comprises (c) that said coarse material has an average particle size which is larger then the average particle size of the ultimate particle size distribution, and said fine material has a particle size smaller than that of the coarse material but is adapted to become the coarser portion of the material in the completed slurry and (d) that no particle of said fine material is greater than the maximum particle size in said completed slurry, and (e) that the coarse material from stage (b) is milled in at least one further different milling stage to produce a further portion of fine material, the average particle size of which fine material is smaller than the average particle size of the ultimate particle size distribution desired in said completed slurry and which portion of fine material is adapted to become the finer portion of the material in the completed slurry; and (f) that the portions of fine material from the different stages are combined and a slurry is produced of the said combined portions of fine material from the different stages, said slurry consisting essentially of the fine material from stage (b), which constitutes the coarser portion in which no particle is greater than the maximum particle size in said completed slurry, and the fine material from stage (e), which constitutes the finer portion of the material in said completed slurry.

3. A process as claimed in claim 2, wherein the milled product from the last milling stage includes portions of relatively coarse material and relatively fine material and wherein the milled material is also divided into coarse and fine material and only the fine material is employed in making up the final slurry.

4. A process as claimed in claim 2, wherein all the coarse material from the different milling stages but the last one are milled in a succeeding milling stage.

5. A process as claimed in claim 2, wherein only a part of the coarse material from the different milling stages except the last one is milled in a succeeding milling stage, whereas the rest of the coarse material is fed back for renewed milling in the same or a preceding milling stage.

6. A process as claimed in claim 4, wherein the coarse material from the last milling stage is fed back for renewed milling in the same or in a preceding milling stage.

7. A process as claimed in claim 2, wherein the coarse material from the first milling stage has a particle size of at least 50–500 micrometers.

8. A process as claimed in claim 7, wherein the coarse material from the first milling stage has a particle size of at least 50–250 micrometers.

9. A process as claimed in claim 2, wherein the coarse material from the first milling stage comprises 5–50% by weight of the total amount of material passing the first milling stage.

10. A process as claimed in claim 2, wherein the particle size of the coarse material separated in the first milling stage is larger than the maximum particle size of the ultimate particle size distribution.

11. A slurry of pulverized carbonaceous material produced according to claim 2.

* * * * *

UNITED STATES PATENT AND TRADEMARK OFFICE

CERTIFICATE OF CORRECTION

PATENT NO. : 4,887,383

DATED : Dec. 19, 1989

INVENTOR(S) : Mait M. Mathiesen, Lars I. Gillberg, Karl M. E. Hellsten and Gunvor B. T. Karlsson It is certified that error appears in the above-identified patent and that said Letters Patent is hereby corrected as shown below:

Title Page [56] References Cited, U. S. Patent Documents, last line, 3rd column; "Rusmussen et al" should read -- Rasmussen et al --. (See original LP #4,369,926)
Column 1, line 15,16; "by products" should read -- by-products --.
Column 1, line 48; "than" should read -- than, --.
Column 1, line 49; "with" should read -- with, --.
Column 1, line 57; "5the" should read -- 5th --.
Column 2, line 39; "slurry" should read -- slurry, --.
Column 2, line 52,53 "operation" should read -- operation, --.
Column 2, line 55 "size" should read -- size, --.
Column 3, line 9, "mill" should read -- mill, --.
Column 3, line 45, "unfavourable" should read -- unfavorable --.
Column 4, line 12; "This" should read -- This, --
Column 4, line 13; "invention" should read -- invention, --.
Column 6, line 1; "fuel" should read -- fuel, --.
Column 6, line 24; "campaign" should read -- campaign, --.
Column 6, line 26; "size" should read -- size, --.
Column 7, line 4; "benificiated" should read -- beneficiated --.
Column 7, line 60; "particle which" should read -- particle size which --.
Column 8, line 8; "material" should read -- material, --.

Signed and Sealed this

Eleventh Day of December, 1990

*Attest:*

*Attesting Officer*

HARRY F. MANBECK, JR.

*Commissioner of Patents and Trademarks*